US010242779B2

(12) United States Patent
Nagata et al.

(10) Patent No.: US 10,242,779 B2
(45) **Date of Patent: *Mar. 26, 2019**

(54) MANUFACTURING METHOD OF AN ALLOY POWDER FOR RARE EARTH MAGNET AND THE RARE EARTH MAGNET BASED ON HEAT TREATMENT

(71) Applicant: XIAMEN TUNGSTEN CO., LTD., Xiamen, Fujian (CN)

(72) Inventors: Hiroshi Nagata, Fujian (CN); Chonghu Wu, Fujian (CN)

(73) Assignee: XIAMEN TUNGSTEN CO., LTD., Xiamen, Fujian (CN)

( * ) Notice: Subject to any disclaimer, the term of this patent is extended or adjusted under 35 U.S.C. 154(b) by 494 days.

This patent is subject to a terminal disclaimer.

(21) Appl. No.: 14/758,699

(22) PCT Filed: Dec. 30, 2013

(86) PCT No.: PCT/CN2013/090824
§ 371 (c)(1),
(2) Date: Jun. 30, 2015

(87) PCT Pub. No.: WO2014/101854
PCT Pub. Date: Jul. 3, 2014

(65) Prior Publication Data

US 2015/0340136 A1 Nov. 26, 2015

(30) Foreign Application Priority Data

Dec. 31, 2012 (CN) ..... 2012 1 0592341

(51) Int. Cl.

| | |
|---|---|
| ***B22F 1/00*** | (2006.01) |
| ***C21D 6/00*** | (2006.01) |
| ***C22C 38/04*** | (2006.01) |
| ***C22C 38/02*** | (2006.01) |
| ***H01F 1/057*** | (2006.01) |
| ***C22C 38/06*** | (2006.01) |
| ***C22C 38/00*** | (2006.01) |
| ***C22C 38/54*** | (2006.01) |
| ***C22C 38/32*** | (2006.01) |
| ***C22C 38/28*** | (2006.01) |
| ***C22C 38/14*** | (2006.01) |
| ***H01F 41/02*** | (2006.01) |
| ***C22C 38/10*** | (2006.01) |
| ***C22C 38/12*** | (2006.01) |
| ***C22C 38/16*** | (2006.01) |
| ***C22C 38/44*** | (2006.01) |
| ***B22F 9/04*** | (2006.01) |
| ***B22F 3/16*** | (2006.01) |
| ***C21D 1/773*** | (2006.01) |
| ***C22C 38/18*** | (2006.01) |
| ***H01F 1/053*** | (2006.01) |

(52) U.S. Cl.
CPC ..... *H01F 1/057* (2013.01); *B22F 1/0003* (2013.01); *B22F 1/0085* (2013.01); *B22F 3/162* (2013.01); *B22F 9/04* (2013.01); *C21D 1/773* (2013.01); *C21D 6/00* (2013.01); *C22C 38/002* (2013.01); *C22C 38/004* (2013.01); *C22C 38/005* (2013.01); *C22C 38/007* (2013.01); *C22C 38/008* (2013.01); *C22C 38/02* (2013.01); *C22C 38/04* (2013.01); *C22C 38/06* (2013.01); *C22C 38/10* (2013.01); *C22C 38/12* (2013.01); *C22C 38/14* (2013.01); *C22C 38/16* (2013.01); *C22C 38/18* (2013.01); *C22C 38/28* (2013.01); *C22C 38/32* (2013.01); *C22C 38/44* (2013.01); *C22C 38/54* (2013.01); *H01F 1/0536* (2013.01); *H01F 1/0577* (2013.01); *H01F 41/02* (2013.01); *H01F 41/0266* (2013.01); *H01F 41/0293* (2013.01); *B22F 2009/044* (2013.01); *B22F 2999/00* (2013.01); *C22C 2202/02* (2013.01)

(58) Field of Classification Search
CPC ..... H01F 1/053
See application file for complete search history.

(56) References Cited

U.S. PATENT DOCUMENTS 5,536,330 A * 7/1996 Chen ..... B01J 3/006 134/21
6,352,597 B1 * 3/2002 Gutfleisch ..... B22F 9/023 148/101

(Continued)

FOREIGN PATENT DOCUMENTS

CN 1234589 A 11/1999
CN 101238530 A 8/2008

(Continued)

OTHER PUBLICATIONS

S. Larrabee, Controlled Atmosphere Chambers, Induction Heating and Heat Treatment. vol. 4C, ASM Handbook, ASM International, 2013, p. 691-700.*

*Primary Examiner* — Christopher S Kessler
*Assistant Examiner* — Rajinder Bajwa
(74) *Attorney, Agent, or Firm* — Cooper Legal Group, LLC

(57) ABSTRACT

A manufacturing method of an alloy powder for rare earth magnet and the rare earth magnet based on heat treatment includes the following: an alloy of the rare earth magnet is firstly coarsely crushed and then finely crushed by jet milling to obtain a fine powder; the fine powder is obtained by being heated in vacuum or in inert gas atmosphere at a temperature of 100° C.~1000° C. for 6 minutes to 24 hours. The heat treatment of fine powder is performed after the process of finely crushed jet milling before the process of compacting under a magnetic field, so that the sintering property of the powder is changed drastically, and it obtains a magnet with a high coercivity, a high squareness and a high heat resistance.

12 Claims, No Drawings

(56) References Cited

U.S. PATENT DOCUMENTS

| | | | | |
|---|---|---|---|---|
| 2008/0251159 | A1* | 10/2008 | Odaka | B22F 9/002 148/121 |
| 2010/0247367 | A1* | 9/2010 | Nakamura | B22F 3/087 419/27 |
| 2012/0237769 | A1* | 9/2012 | Maeda | B22F 3/02 428/402 |

FOREIGN PATENT DOCUMENTS

| | | | | |
|---|---|---|---|---|
| CN | 101819841 | A | | 9/2010 |
| CN | 102103916 | A | | 6/2011 |
| CN | 102274974 | A | * | 12/2011 |
| CN | 102274974 | A | | 12/2011 |
| CN | 102586682 | A | | 7/2012 |
| CN | 102682987 | A | | 9/2012 |
| CN | 103050267 | A | | 4/2013 |
| JP | 04221005 | A | * | 8/1992 |
| JP | 2011023436 | A | | 2/2011 |

* cited by examiner

MANUFACTURING METHOD OF AN ALLOY POWDER FOR RARE EARTH MAGNET AND THE RARE EARTH MAGNET BASED ON HEAT TREATMENT

FIELD OF THE INVENTION

The present invention relates to magnet manufacturing technique field, especially to a manufacturing method of an alloy powder for rare earth magnet and the rare earth magnet based on heat treatment.

BACKGROUND OF THE INVENTION

Rare earth magnet is based on intermetallic compound $R_2T_{14}B$, thereinto, R is rare earth element, T is iron or transition metal element replacing iron or part of iron, B is boron; Rare earth magnet is called the king of the magnet as its excellent magnetic properties, the max magnetic energy product (BH)max is ten times higher than that of the ferrite magnet (Ferrite); besides, the maximum operation temperature of the rare earth magnet may reach 200° C., which has an excellent machining property, a hard quality, a stable performance, a high cost performance and a wide applicability.

There are two types of rare earth magnets depending on the manufacturing method: one is sintered magnet and the other one is bonded magnet. The sintered magnet of which has wider applications. In the conventional technique, the process of sintering the rare earth magnet is mainly performed as follows: raw material preparing→melting→casting→hydrogen decrepitation (HD)→jet milling (JM)→compacting under a magnetic field→sintering→heat treatment→magnetic property evaluation→oxygen content evaluation of the sintered magnet→machining→surface treatment and so on.

The development history of the sintered rare earth magnet cannot be overly summarized in a word that it is the developing of improving the content rate of the main phase and reducing the constitute of the rare earth. Recently, to improve (BH)max and coercivity, the integral anti-oxidization technique of the manufacturing method is developing continuously, so the oxygen content of the sintered magnet can be reduced to below 2500 ppm at present; however, if the oxygen content of the sintered magnet is too low, the affects of some unstable factors like micro-constituent fluctuation or infiltration of impurity during the process may be amplified, so that it may result in over sintering, abnormal grain growth (AGG), low coercivity, low squareness, low heat resistance property and so on.

SUMMARY OF THE INVENTION

The present invention overcomes the disadvantages of the conventional technique and provide a manufacture method of an alloy powder for rare earth magnet and the rare earth magnet based on heat treatment, the process of heat treatment for fine powder is added after the finely crushed jet milling process and before the compacting process under a magnetic field, so that the sintering property of the powder is changed drastically, it can obtain a magnet with a high coercivity, a high squareness and a high heat resistance.

The technical proposal of the present invention to solve the technical problem is that:

A manufacturing method of a powder for rare earth magnet based on heat treatment, the rare earth magnet comprises $R_2T_{14}B$ main phase, R is selected from at least one rare earth element including yttrium, and T is at least one transition metal element including the element Fe; the method comprising the steps of: coarsely crushing an alloy for the rare earth magnet and then finely crushing by jet milling to obtain a fine powder; and heating the fine powder in vacuum or in inert gas atmosphere at a temperature of 100° C.~1000° C. for 6 minutes to 24 hours.

The present invention can achieve the above mentioned effects by adding the process of the heat treatment of the fine powder, the reason is that, with the heat treatment of the fine powder, it has the phenomena as below:

1. tiny amounts of oxidation layer is generated on the surface of the overall powder in the vacuum condition or the inert gas atmosphere condition under the work of the inevitable oxidizing gas, and therefore the oxidative activity of the powder is weakened in the following process;

2. the sharp edge of the alloy powder is melted and becomes round, thus it reduces the contact area between the powder, the lubricating property of the powder is better, the lattice defect of the surface of the powder is recovered, and therefore the orientation degree of the powder and the coercivity of the magnet are improved;

3. The scratch on the surface of the powder is removed by the hardening effect, so that it avoids the loss of sintering promotion effect due to the defect or other facts.

With above factors and combined, the property of the powder is changed drastically, so that it can obtain a magnet with a high coercivity, a high squareness and a high heat resistance.

In another preferred embodiment, the temperature of the process of fine powder heat treatment is 300° C.~700° C.

In another preferred embodiment, in the fine powder heat treatment process, the fine powder is vibrated or shaken. To prevent adhesive and condensation of the powder, a rotating furnace or the like is preferably used to improve the manufacturing efficiency.

In another preferred embodiment, in vacuum condition of the fine powder heat treatment process, the pressure is configured in a range of $10^{-2}$ Pa~500 Pa with an oxygen content of 0.5 ppm~2000 ppm and a dew point of −60° C.~20° C. By a number of experiments, the present invention is capable of controlling the content of the oxidizing gas (including water and oxygen) in the gas atmosphere, the surface of the overall powder only generates tiny amounts of oxidation layer, therefore the fine powder after heat treatment has an excellent lubricating property, and performs an oxidation resistance property in the following sintering process and the heavy rare-earth element diffusion process, thus obtaining a magnet with a high coercivity, a high squareness and a high heat resistance property. In addition, as the vacuum pressure is configured as below 500 Pa, it is much lower than the standard atmospheric pressure; according to the mean free path formula, the mean free path of the oxidizing gas is inversely proportional to the pressure P, so that the oxidizing gas and the powder react more evenly, the powder disposed on the top layer, the central layer and the bottom layer can all perform oxidation reaction, thus obtaining a powder with an excellent property.

In another preferred embodiment, in the inert gas atmosphere condition of the fine powder heat treatment process, the pressure is configured in a range of $10^{-1}$ Pa~1000 Pa with an oxygen content of 0.5 ppm~2000 ppm and a dew point of −60° C.~20° C.

In another preferred embodiment, the alloy for the rare earth magnet is obtained by strip casting an molten alloy fluid of raw material and being cooled at a cooling rate between $10^{2}$° C./s to $10^{4}$° C./s.

In another preferred embodiment, the coarse crushing process is a process that the alloy for the rare earth magnet is firstly treated by hydrogen decrepitation under a hydrogen pressure between 0.01 MPa to 1 MPa for 0.5~6 hours and then is dehydrogenated in vacuum.

In another preferred embodiment, counted in atomic percent, the component of the alloy is $R_eT_fA_gJ_hG_iD_k$, wherein R is Nd or comprising Nd and selected from at least one of the elements La, Ce, Pr, Sm, Gd, Dy, Tb, Ho, Er, Eu, Tm, Lu and Y; T is Fe or comprising Fe and selected from at least one of the elements Ru, Co and Ni; A is B or comprising B and selected from at least one of the elements C or P; J is selected from at least one of the elements Cu, Mn, Si and Cr; G is selected from at least one of the elements Al, Ga, Ag, Bi and Sn; D is selected from at least one of the elements Zr, Hf, V, Mo, W, Ti and Nb; and the subscripts are configured as:

the atomic percent at % of e is $12 \le e \le 16$,
the atomic percent at % of g is $5 \le g \le 9$,
the atomic percent at % of h is $0.05 \le h \le 1$,
the atomic percent at % of i is $0.2 \le i \le 2.0$,
the atomic percent at % of k is $0 \le k \le 4$,
the atomic percent at % of f is $f = 100 - e - g - h - i - k$.

It has to be noted that, as the elements O, N are impurities may be easily infiltrated during operation, the alloy powder may mix with a little regular amount of the elements O, N.

The present invention further provides a manufacturing method of the rare earth magnet.

A manufacturing method of rare earth magnet, the rare earth magnet comprises $R_2T_{14}B$ main phase, R is selected from at least one rare earth element including yttrium, and T is selected from at least one transition metal element including Fe; the method comprising the steps of: coarsely crushing an alloy for the rare earth magnet and then finely crushing by jet milling to obtain a fine powder; heating the fine powder in vacuum or in inert gas atmosphere at a temperature of 100° C.~1000° C. for 6 minutes to 24 hours, compacting the fine powder under a magnet field and sintering in vacuum or in inert gas atmosphere at a temperature of 950° C.~1140° C.

Compared to the conventional technique, the present invention has advantages as follows:

1. the finely crushed fine powder is heated at a temperature of 100° C.~1000° C. for 6 minutes to 24 hours, with the heat treatment of the fine powder, the property of the powder changes drastically, so that it obtains a magnet with a high coercivity, a high squareness, and a high heat resistance;

2. compared to the conventional technique, the powder can be sintered at a temperature that is 20~40° C. higher than that of conventional method, and the phenomenon of abnormal grain growth (AGG) would not happen, so that the powder after heat treatment can be sintered in an extremely wide sintering temperature range and the manufacturing condition is expanded.

DETAILED DESCRIPTION OF THE EMBODIMENTS

The present invention will be further described with the embodiments.

Embodiment 1

Raw material preparing process: Nd, Pr, Dy, Tb and Gd with 99.5% purity, industrial Fe—B, industrial pure Fe, Co with 99.9% purity and Cu, Mn, Al, Ag, Mo and C with 99.5% purity are prepared; counted in atomic percent, and prepared in $R_eT_fA_gJ_hG_iD_k$ components.

The contents of the elements are shown in TABLE 1:

TABLE 1

| proportioning of each element | | | | | | | | | | | | | |
|---|---|---|---|---|---|---|---|---|---|---|---|---|---|
| R | | | | | T | | A | | J | | G | | D |
| Nd | Pr | Dy | Tb | Gd | Fe | Co | C | B | Cu | Mn | Al | Ag | Mo |
| 7 | 3 | 1 | 1 | 1 | remainder | 1 | 0.05 | 7 | 0.2 | 0.2 | 0.2 | 0.1 | 1 |

Preparing 500 Kg raw material by weighing in accordance with TABLE 1.

Melting process: the 500 Kg raw material is put into an aluminum oxide made crucible, an intermediate frequency vacuum induction melting furnace is used to melt the raw material in 1 Pa vacuum below 1650° C.

Casting process: After the process of vacuum melting, Ar gas is filled into the melting furnace so that the Ar pressure would reach 80000 Pa, then the material is casted as a strip with an average thickness of 0.3 mm by strip casting method.

Hydrogen decrepitation process (coarse crushing process): the strip of 0.3 mm average thickness is put into a stainless steel container of a rotating hydrogen decrepitation furnace, the inner diameter of the container is ϕ1200 mm, the container is then pumped to be vacuum and the vacuum level is below 10 Pa, then hydrogen of 99.999% purity is filled into the container, the hydrogen pressure would reach 0.12 MPa, the container rotates for 2 hours at a rotating rate of 1 rpm to absorb hydrogen, after that, the container is pumped for 2 hours at 600° C. to dehydrogenate, then the container rotates and gets cooled at a rotating rate of 30 rpm simultaneously, the cooled coarse powder is then taken out.

Fine crushing process: a jet milling device is used to finely crush the coarse powder to obtain a fine powder with an average particle size of 4.2 nm.

Fine powder heat treatment process: the fine powder is divided into 8 equal parts, each part is respectively put into a stainless steel container of a rotating hydrogen decrepitation furnace, the inner diameter of the container is ϕ1200 mm, the container is then pumped to be vacuum to obtain a pressure of $10^{-1}$ Pa with an oxygen content of 1~1000 ppm, and a dew point of 0~10° C., then the stainless steel container is put to an externally heating oven for heat treatment.

The heating temperature and heat treatment time of each part of fine powder are shown in TABLE 2, the stainless steel container rotates at a rotating rate of 10 rpm when heated.

After the heat treatment of the fine powder, the container is taken out of the externally heating oven, the container is then externally water cooled at a rotating rate of 20 rpm for 3 hours.

Compacting process under a magnetic field: no organic additive such as forming aid and lubricant is added into the fine powder with the process of fine powder heat treatment, a transversed type magnetic field molder is used, the powder is compacted in once to form a cube with sides of 40 mm in an orientation field of 2.1 T and under a compacting pressure of 0.2 ton/cm$^2$, then the once-forming cube is demagnetized in a 0.2 T magnetic field.

The once-forming compact (green compact) is sealed so as not to expose to air, the compact is secondary compacted by a secondary compact machine (isostatic pressing compacting machine) under a pressure of 1.0 ton/cm$^2$.

Sintering process: each of the green compact is moved to the sintering furnace, firstly sintering in a vacuum of $10^{-3}$ Pa and respectively maintained for 2 hours at 200° C. and for 2 hours at 600° C., then in Ar gas atmosphere of 0.01 MPa, sintering for 2 hours at 1080° C., after that filling Ar gas into the sintering furnace so that the Ar pressure would reach 0.1 MPa, then cooling it to room temperature.

Heat treatment process: the sintered magnet is heated for 1 hour at 600° C. in the atmosphere of high purity Ar gas, then cooling it to room temperature and taking it out.

Magnetic property evaluation process: the sintered magnet is tested by NIM-10000H type nondestructive testing system for BH large rare earth permanent magnet from China Jiliang University.

Oxygen content of sintered magnet evaluation process: the oxygen content of the sintered magnet is measured by EMGA-620W type oxygen and nitrogen analyzer from HORIBA company of Japan.

TABLE 2

The magnetic property and oxygen content evaluation of the embodiments and the comparing samples in different heating temperature and heating time.

| No. | | Heating temperature (° C.) | Heating time (hr) | Br (kGs) | Hcj (k0e) | SQ (%) | (BH)max (MG0e) | Oxygen content of the sintered magnet (ppm) |
|---|---|---|---|---|---|---|---|---|
| 0 | Comparing sample | No heat treatment of the fine powder | | 10.1 | 11.4 | 82 | 21.4 | 2580 |
| 1 | Comparing sample | 80 | 30 | 10.2 | 11.6 | 82.3 | 22.8 | 1589 |
| 2 | Embodiment | 100 | 24 | 12 | 35.1 | 98.2 | 31.2 | 562 |
| 3 | Embodiment | 300 | 6 | 12.3 | 35.4 | 99.1 | 35.3 | 375 |
| 4 | Embodiment | 500 | 4 | 12.3 | 36.7 | 99.1 | 35.2 | 369 |
| 5 | Embodiment | 700 | 1 | 12.3 | 37.8 | 99.2 | 35.2 | 383 |
| 6 | Embodiment | 1000 | 0.3 | 11.8 | 34.5 | 98.5 | 33.2 | 582 |
| 7 | Comparing sample | 1020 | 0.5 | 10.6 | 27.6 | 84.2 | 23.2 | 1587 |
| 8 | Comparing sample | 1050 | 12 | 10.2 | 24.3 | 78.6 | 16.5 | 2598 |

As can be seen from TABLE 2, with the heat treatment of the fine powder, a very thin oxidation film is formed on the surface of the overall powder evenly, so that the lubricity is well among the powder, thus improving the orientation degree of the powder, so that it can obtain a higher value of Br and (BH)max; furthermore, the phenomenon of abnormal grain growth would not happen when sintering, so that it can obtain a finer organization, and the value of coercivity Hcj is increased drastically; in addition, by the heat treatment of the fine powder, the sharp portion on the surface of the powder is melted and becomes round, so the counter magnetic field coefficient at the partial portion is increased, it can also obtain a higher coercivity. Moreover, during the processes from compacting to sintering, the powder with even oxidation film on the surface is weakened in activity, so that during those processes, even the powder is contacted with the air, drastic oxidation would not happen; on the contrary, the fine powder without heat treatment has a strong activity and is easily oxidized, during the processes from compacting to sintering, even contacted with a little amount of air, drastic oxidation would happen, leading to a higher oxygen content of the sintered magnet.

It has to be noted that, if the heating temperature of the fine powder exceeds 1000° C., the oxidation film on the surface of the fine powder particle is easily diffused into the particle, consequently it would be like no oxidation film, therefore the adhesive power among the powder gets stronger, in this case, the values of Br, (BH)max would be extremely adverse, the phenomenon of abnormal grain growth would easily happen when sintering, and the value of coercivity Hcj would be reduced.

In the low oxygen content process of the conventional technique, as the adhesive power among the magnet powder is strong, and the orientation degree of the magnet powder is not too high, so that it also has problems of low values of Br and (BH)max; moreover, as the surface activity between the magnet powder is strong, the grains are easily welded when sintering, therefore the phenomenon of abnormal grain growth happens, and the value of coercivity is reduced rapidly. The above mentioned problems are solved by adopting the proposal of the present invention.

Embodiment 2

Raw material preparing process: Nd, Y with 99.9% purity, industrial Fe—B, industrial pure Fe—P, industrial Fe—Cr, industrial pure Fe, Ni, Si with 99.9% purity, and Sn, W with 99.5% purity are prepared.

Counted in atomic percent, and prepared in $R_eT_fA_gJ_hG_iD_k$ components.

The contents of the elements are shown in TABLE 3:

TABLE 3 proportioning of each element

| R | | T | | A | | J | | G | D |
|---|---|---|---|---|---|---|---|---|---|
| Nd | Y | Fe | Ni | B | P | Cr | Si | Sn | W |
| 12.7 | 0.1 | remainder | 0.1 | 5.9 | 0.05 | 0.2 | 0.1 | 0.3 | 0.01 |

Preparing 500 Kg raw material by weighing in accordance with TABLE 3.

Melting process: the 500 Kg raw material is put into an aluminum oxide made crucible, an intermediate frequency vacuum induction melting furnace is used to melt the raw material in $10^{-2}$ Pa vacuum below 1600° C.

Casting process: After the process of vacuum melting, Ar gas is filled into the melting furnace so that the Ar pressure would reach 50000 Pa, then the material is casted as a strip with an average thickness of 2 mm on a water-cooling casting disk.

Hydrogen decrepitation process: the strip is put into a stainless steel container of a rotating hydrogen decrepitation furnace, the inner diameter of the container is ϕ1200 mm, the container is then pumped to be vacuum and the vacuum level is below 10 Pa, then hydrogen of 99.999% purity is filled into the container, the hydrogen pressure would reach 0.12 MPa, the container rotates for 2 hours at a rotating rate of 1 rpm to absorb hydrogen, after that, the container is pumped for 2 hours at 600° C. to dehydrogenate, then the container rotates and gets cooled at a rotating rate of 30 rpm simultaneously, the cooled coarse powder is then taken out.

Fine crushing process: a jet milling device is used to finely crush the coarse powder to obtain a fine powder with an average particle size of 6.8 nm, then the powder is divided into 6 equal parts.

Fine powder heat treatment process: 4 parts of the fine powder are respectively put into the stainless steel container of a rotating hydrogen decrepitation furnace, the inner diameter of the container is ϕ1200 mm, the container is then pumped to be vacuum to obtain a vacuum level of $10^{-2}$ Pa with an oxygen content of 0.5~50 ppm, and a dew point of 10~20° C., then the stainless steel container is put to an externally heating oven for heat treatment; the heating temperature is 600° C., the heating time is 2 hours, and the container is heated at a rotating rate of 1 rpm.

After the heat treatment of the fine powder, the container is taken out of the externally heating oven, the container is then externally water cooled at a rotating rate of 20 rpm for 3 hours.

Compacting process under a magnetic field: no organic additive is added into the 4 parts of fine powder with the process of fine powder heat treatment and the rest 2 parts of fine powder without the process of fine powder heat treatment, and the transversed type magnetic field molder is respectively used for the two types of powder, the two types of powder are respectively compacted in once to form a cube with sides of 40 mm in an orientation field of 2 T and under a compacting pressure of 0.20 ton/cm$^2$, then the once-forming cube is demagnetized in a 0.2 T magnetic field. The once-forming compact (green compact) is sealed so as not to expose to air, then the compact is secondary compacted by a secondary compacting machine (isostatic pressing compacting machine) under a pressure of 1.2 ton/cm$^2$.

Sintering process: each of the green compact is moved to the sintering furnace, firstly sintering in a vacuum of $10^{-3}$ Pa and respectively maintained for 2 hours at 300° C. and for 2 hours at 500° C., then sintering for 6 hours at 1050° C., after that filling Ar gas into the sintering furnace so that the Ar pressure would reach 0.1 MPa, then cooling it to room temperature.

Heat treatment process: the sintered magnet is heated for 1 hour at 550° C. in the atmosphere of high purity Ar gas, then cooling it to room temperature and taking it out.

Machining process: the sintered magnet made by the 2 parts of fine powder without fine powder heat treatment is machined to be a magnet with ϕ15 mm diameter and 5 mm thickness, the 5 mm direction (along the direction of thickness) is the orientation direction of the magnetic field; one sintered magnet of which is served as no grain boundary diffusion treatment and is tested its magnetic property (comparing sample 1), the other magnet is treated by Method A in TABLE 4 for grain boundary diffusion treatment after washed and surface cleaning (comparing sample 2).

The 4 parts of sintered magnet made by fine powder with fine powder heat treatment is machined to be a magnet with ϕ15 mm and 5 mm thickness, the 5 mm direction (the direction along the thickness) is the orientation direction of the magnetic field; one magnet of which is served as no grain boundary diffusion treatment and is directly tested its magnetic property (comparing sample 3).

Grain boundary diffusion process: the other 3 parts of the sintered magnet made of fine powder with heat treatment are respectively treated by Methods A, B, and C in TABLE 4 for grain boundary diffusion treatment after washed and surface cleaning.

TABLE 4 grain boundary diffusion method

| | Grain boundary diffusion type | Detailed process |
|---|---|---|
| A | Dy oxide powder, Tb fluoride powder coating diffusion method | Dy oxide and Tb fluoride are prepared in proportion of 3:1 to make raw material to fully spray and coat on the magnet, the coated magnet is then dried, then in high purity of Ar gas atmosphere, the magnet is treated with heat and diffusion treatment at 850° C. for 12 hours. |
| B | (Dy, Tb)—Ni—Co—Al serial alloy fine powder coating diffusion method | The $Dy_{30}Tb_{30}Ni_5Co_{25}Al_{10}$ alloy is finely crushed as fine powder with an average grain particle size 15 μm to fully spray and coat on the magnet, the coated magnet is then dried, then in high purity of Ar gas atmosphere, the magnet is treated with heat and diffusion treatment at 900° C. for 12 hours. |
| C | Dy metal vapor diffusion method | In Ar gas atmosphere, the Dy metal plate, Mo screen and magnet are put into a vacuum heating furnace for vapor treatment at 1010° C. for 6 hours. |

Magnetic property evaluation process: the sintered magnet is tested by NIM-10000H type nondestructive testing system for BH large rare earth permanent magnet from China Jiliang University.

Oxygen content of sintered magnet evaluation process: the oxygen content of the sintered magnet is measured by EMGA-620W type oxygen and nitrogen analyzer from HORIBA company of Japan.

The magnetic property and oxygen content evaluation of the embodiments and the comparing samples with the fine powder heat treatment and the grain boundary diffusion treatment are shown in TABLE 5.

TABLE 5

The magnetic property and oxygen content evaluation of the embodiments and the comparing samples

| No. | | Heat treatment of the fine powder | Grain boundary diffusion | Br (kGs) | Hcj (k0e) | SQ (%) | (BH)max (MG0e) | Oxygen content of the sintered magnet (ppm) |
|---|---|---|---|---|---|---|---|---|
| 0 | Comparing sample 1 | no | no | 13.1 | 6.5 | 76.5 | 23.1 | 2687 |

TABLE 5-continued

The magnetic property and oxygen content evaluation of the embodiments and the comparing samples

| No. | | Heat treatment of the fine powder | Grain boundary diffusion | Br (kGs) | Hcj (k0e) | SQ (%) | (BH)max (MG0e) | Oxygen content of the sintered magnet (ppm) |
|---|---|---|---|---|---|---|---|---|
| 1 | Comparing sample 2 | no | A | 13.2 | 13.2 | 86.6 | 32.5 | 2785 |
| 2 | Comparing sample 3 | yes | no | 15.4 | 9.5 | 86.7 | 46.4 | 421 |
| 3 | Embodiment | yes | A | 15.5 | 22.3 | 98.4 | 56.5 | 278 |
| 4 | Embodiment | yes | B | 15.6 | 22.4 | 99.2 | 56.8 | 276 |
| 5 | Embodiment | yes | C | 15.6 | 24.2 | 99.1 | 57.2 | 289 |

As can be seen from TABLE 5, the magnet sintered by the fine powder with fine powder heat treatment has an obvious change in the existence state of the oxygen in the grain boundary, the diffusion rate of the elements Dy, Tb is accelerated and the diffusion efficiency is promoted, so that the grain boundary diffusion can be finished in a short time, the effect of the grain boundary diffusion is obvious and the coercivity is improved significantly.

Embodiment 3

Raw material preparing process: La, Ge, Nd, Tb, and Ho with 99.5% purity, industrial Fe—B, industrial pure Fe, Ru with 99.99% purity and P, Si, Cr, Ga, Sn, Zr with 99.5% purity are prepared; counted in atomic percent, and prepared in $R_eT_fA_gJ_hG_iD_k$ components.

The contents of the elements are shown as follows:

R component, La is 0.1, Ce is 0.1, Nd is 12, Tb is 0.2, and Ho is 0.2;

T component, Fe is the remainder, Ru is 1;

A component, P is 0.05, B is 7;

J component, Si is 0.2, Cr is 0.2;

G component, Ga is 0.2, Sn is 0.1;

D component, Zr is 0.5.

Preparing 500 Kg raw material by weighing in accordance with above contents of elements.

Melting process: the 500 Kg raw material is put into an aluminum oxide made crucible, an intermediate frequency vacuum induction melting furnace is used to melt the raw material in 1 Pa vacuum below 1650° C.

Casting process: Ar gas is filled to the melting furnace so that the Ar pressure would reach 80000 Pa after vacuum melting, then the material is casted as a strip with an average thickness of 0.15 mm by strip casting method (SC).

Hydrogen decrepitation process: the strip is put into a stainless steel container of a rotating hydrogen decrepitation furnace, the inner diameter of the container is ϕ1200 mm, the container is then pumped to be vacuum and the vacuum level is below 10 Pa, then hydrogen of 99.999% purity is filled into the container, the hydrogen pressure would reach 0.12 MPa, the container rotates for 2 hours at a rotating rate of 1 rpm to absorb hydrogen, after that, the container is pumped for 2 hours at 600° C. to dehydrogenate, then the container rotates and gets cooled at a rotating rate of 30 rpm simultaneously, the cooled coarse powder is then taken out.

Fine crushing process: a jet milling device is used to finely crush the coarse powder to obtain a fine powder with an average particle size of 5 nm.

Fine powder heat treatment process: the fine powder is divided into 6 equal parts, each part is respectively put into the stainless steel container of a rotating hydrogen decrepitation furnace, the inner diameter of the container is ϕ1200 mm, the container is then pumped to be vacuum and the vacuum level is below 10 Pa, then Ar gas with 99.9999% purity is filled into the container to obtain a pressure of 500 Pa, the oxygen content is controlled as 1800~2000 ppm, and the dew point is −60~50° C., then the stainless steel container is put into an externally heating oven for heat treatment, the stainless steel container rotates at a rotating rate of 5 rpm when heated.

The heating temperature and heat treatment time of each part of fine powder are shown in TABLE 6.

After the process of fine powder heat treatment, the container is taken out of the externally heating oven, the container is then externally water cooled at a rotating rate of 20 rpm for 3 hours.

Compacting process under a magnetic field: no organic additive is added into the fine powder with the process of fine powder heat treatment, a transversed type magnetic field molder is directly used, the powder is compacted in once to form a cube with sides of 40 mm in an orientation field of 1.8 T and under a compacting pressure of 1.2 ton/cm$^2$, then the once-forming cube is demagnetized in a 0.2 T magnetic field. The once-forming compact (green compact) is sealed so as not to expose to air, and then the green compact is delivered to a sintering furnace.

Sintering process: each of the green compact is moved to the sintering furnace to sinter, in a vacuum of $10^{-3}$ Pa and respectively maintained for 2 hours at 200° C. and for 2 hours at 600° C., then in Ar gas atmosphere of 0.02 MPa, sintering for 2 hours at 1080° C., after that filling Ar gas into the sintering furnace so that the Ar pressure would reach 0.1 MPa, then cooling it to room temperature.

Heat treatment process: the sintered magnet is heated for 1 hour at 600° C. in the atmosphere of high purity Ar gas, then cooling it to room temperature and taking it out.

Magnetic property evaluation process: the sintered magnet is tested by NIM-10000H type nondestructive testing system for BH large rare earth permanent magnet from China Jiliang University, and an average value is calculated.

Oxygen content of sintered magnet evaluation process: the oxygen content of the sintered magnet is measured by EMGA-620W type oxygen and nitrogen analyzer from HORIBA company of Japan.

The magnetic property and oxygen content evaluation of the embodiments and the comparing samples in same heating temperature and different heating time with the process of fine powder heat treatment are shown in TABLE 6.

TABLE 6

The magnetic property and oxygen content evaluation of the embodiments and the comparing samples

| No. | | Heating temperature (° C.) | Heating time (hr) | Br (kGs) | Hcj (k0e) | SQ (%) | (BH)max (MG0e) | Oxygen content of the sintered magnet (ppm) |
|---|---|---|---|---|---|---|---|---|
| 0 | Comparing sample | 700 | 0.05 | 13.8 | 9.8 | 81.2 | 45.3 | 2980 |
| 1 | Embodiment | 700 | 0.1 | 15.1 | 13.3 | 97.8 | 54.3 | 565 |
| 2 | Embodiment | 700 | 1 | 15.2 | 13.6 | 98.2 | 54.8 | 354 |
| 3 | Embodiment | 700 | 4 | 15.3 | 14.2 | 99.1 | 55.2 | 375 |
| 4 | Embodiment | 700 | 12 | 15.4 | 14.1 | 99.2 | 56 | 395 |
| 5 | Embodiment | 700 | 24 | 15.3 | 13.5 | 99.1 | 55.3 | 573 |
| 6 | Comparing sample | 700 | 48 | 14.9 | 11.7 | 94.8 | 52.7 | 980 |

As can be seen from TABLE 6, at a temperature of 700° C., if the time of the fine powder heat treatment is less than 0.1 hour, the effect of the heat treatment of the fine powder is not sufficient, resulting in that it would be like no oxidation film, therefore the adhesive power among the powder gets stronger, in this case, the values of Br, (BH)max would be extremely adverse, the phenomenon of abnormal grain growth would easily happen when sintering, and the value of coercivity would be reduced.

At the same time, at a temperature of 700° C., when the time of the fine powder heat treatment process exceeds 24 hours, the oxidation film on the surface of the fine powder particle would be absorbed and diffused into the particle, it would be like no oxidation film, consequently the oxygen content increases, in this case, the values of Br, (BH)max would be reduced, the phenomenon of abnormal grain growth would easily happen when sintering, the value of coercivity Hcj would be reduced.

Embodiment 4

Raw material preparing process: Lu, Er, Nd, Tm, and Y with 99.5% purity, industrial Fe—B, industrial pure Fe, Co with 99.99% purity and C, Cu, Mn, Ga, Bi, Ti with 99.5% purity are prepared, counted in atomic percent, and prepared in $R_eT_fA_gJ_hG_iD_k$ components.

The contents of the elements are shown as follows:

R component, Lu is 0.2, Er is 0.2, Nd is 12, Tm is 0.5, and Y is 0.6;

T component, Fe is the remainder, and Co is 1;

A component, C is 0.05, and B is 7;

J component, Cu is 0.2, and Mn is 0.2;

G component, Ga is 0.2, and Bi is 0.1; and

D component, Ti is 4.

Preparing 500 Kg raw material by weighing in accordance with above contents of elements.

Melting process: the 500 Kg raw material is put into an aluminum oxide made crucible, an intermediate frequency vacuum induction melting furnace is used to melt the raw material in 0.1 Pa vacuum below 1550° C.

Casting process: Ar gas is filled into the melting furnace so that the Ar pressure would reach 40000 Pa after the process of vacuum melting, then the material is casted as a strip with an average thickness of 0.6 mm by strip casting method (SC). Hydrogen decrepitation process: the strip is put into a stainless steel container of a rotating hydrogen decrepitation furnace, the inner diameter of the container is ϕ1200 mm, the container is then pumped to be vacuum and the vacuum level is below 10 Pa, then hydrogen of 99.999% purity is filled into the container, the hydrogen pressure would reach 0.12 MPa, the container rotates for 6 hours at a rotating rate of 2 rpm to absorb hydrogen, after that, the container is pumped for 3 hours at 600° C. to dehydrogenate, then the container rotates and gets cooled at a rotating rate of 10 rpm simultaneously, the cooled coarse powder is then taken out.

Fine crushing process: a jet milling device is used to finely crush the coarse powder to obtain a fine powder with an average particle size of 2 nm.

The fine powder after jet milling is divided into 2 equal parts.

Fine powder heat treatment process: one part of the fine powder is put into the stainless steel container, the inner diameter of the container is ϕ1200 mm, the container is then pumped to be vacuum below 1 Pa, then Ar gas with 99.9999% purity is filled into the container and the pressure reaches 1000 Pa, the oxygen content is controlled as 800~1000 ppm, and the dew point is −50~−40° C., then the stainless steel container is put into an externally heating oven to heat, the heating temperature is 600° C., the heating time is 2 hours. The stainless steel container rotates at a rotating rate of 5 rpm when heated.

After the process of fine powder heat treatment, the container is taken out of the externally heating oven, the container is then externally water cooled at a rotating rate of 5 rpm for 5 hours.

Compacting process under a magnetic field: no organic additive is added into the fine powder with the process of fine powder heat treatment, a transversed type magnetic field molder is directly used, the powder is compacted in once to form a cube with sides of 40 mm in an orientation field of 1.8 T and under a compacting pressure of 1.2 ton/cm$^2$, then the once-forming cube is demagnetized in a 0.2 T magnetic field. The once-forming compact (green compact) is sealed so as not to expose to air, and then the green compact is delivered to a sintering furnace.

Sintering process: each of the green compact is moved to the sintering furnace to sinter, in a vacuum of $10^{-3}$ Pa and respectively maintained for 2 hours at 200° C. and for 2 hours at 600° C., then in Ar gas atmosphere of 0.02 MPa, sintering at 925° C.~1150° C., after that filling Ar gas into the sintering furnace so that the Ar pressure would reach 0.1 MPa, then cooling it to room temperature.

Heat treatment process: the sintered magnet is heated for 1 hour at 600° C. in the atmosphere of high purity Ar gas, then cooling it to room temperature and taking it out.

The other part of the fine powder is not treated with the process of fine powder heat treatment, and served as a comparing sample, which is sequentially treated with the above mentioned compacting process, sintering process and heating process except the process of fine powder heat treatment under the same treatment condition.

Magnetic property evaluation process: the sintered magnet is tested by NIM-10000H type nondestructive testing system for BH large rare earth permanent magnet from China Jiliang University, and an average value is calculated.

Oxygen content of sintered magnet evaluation process: the oxygen content of the sintered magnet is measured by EMGA-620W type oxygen and nitrogen analyzer from HORIBA company of Japan.

The magnetic property and oxygen content evaluation of the embodiments and the comparing samples with or without the process of fine powder heat treatment in different sintering temperatures are shown in TABLE 7. No. 1~11 are the sintered magnet without the process of fine powder heat treatment, No. 12~22 are the sintered magnet with the process of fine powder heat treatment.

TABLE 7

The magnetic property and oxygen content evaluation of the embodiments and the comparing samples

| No. | | Fine powder heat treatment | Sintering temperature (° C.) | Density (g/cc) | Br (kGs) | Hcj (k0e) | SQ (%) | (BH)max (MG0e) | Oxygen content of the sintered magnet (ppm) |
|---|---|---|---|---|---|---|---|---|---|
| 1 | Comparing sample | no | 925 | 6.98 | 12.8 | 12.8 | 76.5 | 25.6 | 2840 |
| 2 | Comparing sample | no | 950 | 7.21 | 13.4 | 12.3 | 93.2 | 39.8 | 2940 |
| 3 | Comparing sample | no | 975 | 7.32 | 13.6 | 12.1 | 95.6 | 43.2 | 2850 |
| 4 | Comparing sample | no | 1000 | 7.38 | 13.9 | 11.9 | 96.3 | 44.5 | 2840 |
| 5 | Comparing sample | no | 1025 | 7.53 | 14.1 | 11.5 | 96.4 | 44.7 | 2840 |
| 6 | Comparing sample | no | 1050 | 7.54 | 14.2 | 11.2 | 96.3 | 45.9 | 2870 |
| 7 | Comparing sample | no | 1075 | 7.56 | 14.2 | 10.9 | 96.4 | 47.1 | 2780 |
| 8 | Comparing sample | no | 1100 | 7.57 | 14.3 | 10.2 | 96.2 | 47.2 | 2790 |
| 9 | Comparing sample | no | 1125 | 7.55 | 14.1 | 9.2 | 92.3 | 46.7 | 2830 |
| 10 | Comparing sample | no | 1140 | 7.51 | 13.8 | 8.5 | 87.4 | 39.8 | 2840 |
| 11 | Comparing sample | no | 1150 | 7.48 | 13.6 | 7.6 | 82.3 | 37.6 | 2980 |
| 12 | Comparing sample | yes | 925 | 7.23 | 13.8 | 9.8 | 81.2 | 45.3 | 982 |
| 13 | Embodiment | yes | 950 | 7.47 | 14.4 | 13.8 | 97.8 | 50.1 | 354 |
| 14 | Embodiment | yes | 975 | 7.49 | 14.4 | 13.6 | 98.2 | 50.2 | 341 |
| 15 | Embodiment | yes | 1000 | 7.51 | 14.5 | 13.5 | 98.3 | 50.4 | 340 |
| 16 | Embodiment | yes | 1025 | 7.54 | 14.5 | 13.4 | 98.4 | 50.4 | 342 |
| 17 | Embodiment | yes | 1050 | 7.56 | 14.6 | 13.4 | 98.5 | 50.6 | 345 |
| 18 | Embodiment | yes | 1075 | 7.59 | 14.6 | 13.4 | 98.6 | 50.8 | 343 |
| 19 | Embodiment | yes | 1100 | 7.61 | 14.7 | 13.4 | 98.9 | 50.8 | 346 |
| 20 | Embodiment | yes | 1125 | 7.64 | 14.7 | 13.4 | 99 | 51.1 | 347 |
| 21 | Embodiment | yes | 1140 | 7.65 | 14.8 | 13.4 | 99.1 | 51.2 | 349 |
| 22 | Comparing sample | yes | 1150 | 7.32 | 13.4 | 12.2 | 76.5 | 38.4 | 768 |

As can be seen from TABLE 7, with heat treatment of the fine powder, it can expand the sintering temperature range to obtain a magnet with an excellent property. The reason is that, it avoids oxidation, so that the compacts can be sintered in a low sintering temperature; on the other hand, when sintering in a high temperature, the phenomenon of abnormal grain growth would not happen, thus it can obtain a magnet with an excellent property whether at the low sintering temperature or at the high sintering temperature.

Although the present invention has been described with reference to the preferred embodiments thereof for carrying out the patent for invention, it is apparent to those skilled in the art that a variety of modifications and changes may be made without departing from the scope of the patent for invention which is intended to be defined by the appended claims.

We claim:

1. A manufacturing method of an alloy powder for rare earth magnet based on heat treatment, the rare earth magnet comprising $R_2T_{14}B$ main phase, R being selected from at least one rare earth element, and T being at least one transition metal element including the element Fe, the method comprising the steps of:

strip casting a molten alloy fluid of raw material and cooling the molten alloy fluid at a cooling rate between $10^{2\circ}$ C./s to $10^{4\circ}$ C./s, to thereby obtain an alloy for the rare earth magnet;

coarsely crushing the alloy for the rare earth magnet to yield a coarsely crushed alloy and subsequently finely crushing the coarsely crushed alloy by jet milling to obtain a fine powder; and heating the fine powder in vacuum, of which a pressure is in a range of $10^{-2}$ Pa-500 Pa with an oxygen content of 0.5 ppm-2000 ppm and a dew point of −60° C.-20° C., or in an inert gas atmosphere, of which a pressure is in a range of $10^{-1}$ Pa-1000 Pa with an oxygen content of 0.5 ppm-2000 ppm and a dew point of −60° C.-20° C., at a temperature of 300° C.-700° C. for 1 hour to 24 hours, to thereby create an oxidation layer evenly on particle surfaces of the fine powder.

2. The manufacturing method according to claim 1, wherein, in the step of heating the fine powder, the fine powder is vibrated or shaken.

3. The manufacturing method according to claim 1, wherein the step of coarsely crushing includes:

treating the alloy for the rare earth magnet by hydrogen decrepitation under a hydrogen pressure between 0.01 MPa to 1 MPa for 0.5-6 hours to yield a treated alloy, and subsequently dehydrogenating the treated alloy in vacuum.

4. The manufacturing method according to claim 2, wherein the alloy for the rare earth magnet is $R_eT_fA_gJ_hG_iD_k$, wherein:

R is Nd or comprises Nd and at least one of the elements La, Ce, Pr, Sm, Gd, Dy, Tb, Ho, Er, Eu, Tm, Lu or Y;

T is Fe or comprises Fe and at least one of the elements Ru, Co or Ni;

A is B or comprises B and at least one of the elements C or P;

J is selected from at least one of the elements Cu, Mn, Si or Cr;

G is selected from at least one of the elements Al, Ga, Ag, Bi or Sn;

D is selected from at least one of the elements Zr, Hf, V, Mo, W, Ti or Nb; and the e, g, h, i, k and f have such values that:

the atomic percent of R is 12 at %-16 at %, the atomic percent of A is 5 at %-9 at %, the atomic percent of J is 0.05 at %-1 at %, the atomic percent of G is 0.2 at %-2.0 at %, the atomic percent of D is 0-4 at %, and the atomic percent of T is (100−e−g−h−i−k) at %.

5. The manufacturing method according to claim 1, wherein the step of coarsely crushing includes:

treating the alloy for the rare earth magnet by hydrogen decrepitation under a hydrogen pressure between 0.01 MPa to 1 MPa for 0.5-6 hours to yield a treated alloy, and subsequently dehydrogenating the treated alloy in vacuum.

6. The manufacturing method according to claim 2, wherein the step of coarsely crushing includes:

treating the alloy for the rare earth magnet by hydrogen decrepitation under a hydrogen pressure between 0.01 MPa to 1 MPa for 0.5-6 hours to yield a treated alloy, and subsequently dehydrogenating the treated alloy in vacuum.

7. The manufacturing method according to claim 1, wherein, in the step of heating the fine powder, a texture of the particle surfaces of the fine powder is changed.

8. The manufacturing method according to claim 1, wherein, in the step of heating the fine powder, edges of the fine powder are smoothed.

9. The manufacturing method according to claim 1, comprising liquid cooling the fine powder after the step of heating the fine powder.

10. The manufacturing method according to claim 9, wherein, in the step of liquid cooling, the fine powder is rotated.

11. The manufacturing method according to claim 9, wherein, in the step of liquid cooling, the fine powder is rotated at a speed of about 20 rotations per minute for about 3 hours.

12. The manufacturing method according to claim 3, wherein the step of coarsely crushing includes:

cooling the treated alloy after the step of dehydrogenating the treated alloy in vacuum.

* * * * *